US007377831B2

(12) United States Patent
Kim et al.

(10) Patent No.: US 7,377,831 B2
(45) Date of Patent: May 27, 2008

(54) PLASMA DISPLAY PANEL AND METHOD OF MANUFACTURING THE SAME

(75) Inventors: Je Seok Kim, Anyang-si (KR); Jin Hyung Ryu, Bucheon-si (KR)

(73) Assignee: LG Electronics Inc., Seoul (KR)

( * ) Notice: Subject to any disclaimer, the term of this patent is extended or adjusted under 35 U.S.C. 154(b) by 408 days.

(21) Appl. No.: 10/950,665

(22) Filed: Sep. 28, 2004

(65) Prior Publication Data

US 2005/0073255 A1 Apr. 7, 2005

(30) Foreign Application Priority Data

Oct. 2, 2003 (KR) ..... 10-2003-0068826

(51) Int. Cl.
*H01J 17/49* (2006.01)
*G03C 5/00* (2006.01)

(52) U.S. Cl. ..... 445/46; 445/24; 313/587; 313/582; 430/321

(58) Field of Classification Search ..... 445/24, 445/46; 430/319, 321; 313/587, 582
See application file for complete search history.

(56) References Cited

U.S. PATENT DOCUMENTS 5,925,203 A * 7/1999 Riddle et al. ..... 159/89.16
6,075,319 A 6/2000 Kanda et al.
6,773,533 B2 * 8/2004 Hanai ..... 156/230

FOREIGN PATENT DOCUMENTS

EP 1 150 320 A1 10/2001
EP 1 308 982 A2 5/2003
JP 10-92325 4/1998

OTHER PUBLICATIONS

European Search Report dated Nov. 15, 2007.

* cited by examiner

*Primary Examiner*—Karabi Guharay
(74) *Attorney, Agent, or Firm*—Ked & Associates, LLP

(57) ABSTRACT

The present invention relates to a plasma display panel, and more particularly, to a plasma display panel and method of manufacturing the same in which a manufacturing process is simple. To this end, in a plasma display panel according to an embodiment of the present invention, metal electrodes are composed of a green tape having a black electrode formed at the bottom and a silver electrode formed at the top, and are formed by exposing the green tape to ultraviolet rays of different wavelengths consecutively. Therefore, it is possible to simplify a manufacturing process of a plasma display panel and to reduce manufacturing cost.

13 Claims, 4 Drawing Sheets

PLASMA DISPLAY PANEL AND METHOD OF MANUFACTURING THE SAME

This Nonprovisional application claims priority under 35 U.S.C. § 119(a) on Patent Application No. 10-2003-068826 filed in Korea on Oct. 2, 2003, the entire contents of which are hereby incorporated by reference.

BACKGROUND OF THE INVENTION

1. Field of the Invention

The present invention relates to a plasma display panel, and more particularly, to a plasma display panel in which a manufacturing process is simplified and method of manufacturing the same.

2. Description of the Background Art

Recently, as a flat panel display device, a plasma display panel (hereinafter, referred to as 'PDP') that can be easily made large attracts public attention. The PDP is adapted to display an image by controlling a gas discharge period of each of pixels according to digital video data. An example of a representative PDP is an AC type PDP that has three electrodes and is driven by alternate current (AC) voltage, as shown in FIG. 1, and is driven by an AC voltage.

FIG. 1 is a perspective view showing the configuration of a cell that is arranged on a typical AC type PDP in a matrix shape. FIG. 2 schematically shows the structure in which electrodes of an upper substrate of the AC type PDP are arranged.

Referring to FIG. 1 and FIG. 2, the cell of the PDP includes an upper plate having a pair of sustain electrodes 14 and 16, an upper dielectric layer 18 and a protection film 20, all of which are sequentially formed on an upper substrate 10; and a lower plate having an address electrode 22, a lower dielectric layer 24, barrier ribs 26 and a phosphor layer 28, all of which are sequentially formed on a lower substrate 12. In the above, the upper substrate 10 and the lower substrate 12 are spaced apart from each other in parallel by means of the barrier ribs 26.

The sustain electrode 14 includes a transparent electrode 14A that has a relatively wide width and is formed using a transparent electrode material (ITO) through which a visible ray can pass, and a metal electrode 14B for compensating for a resistance component of the transparent electrode 14A. Meanwhile, the sustain electrode 16 includes a transparent electrode 16A that has a relatively wide width and is formed using a transparent electrode material (ITO) through which a visible ray can pass, and a metal electrode 16B for compensating for a resistance component of the transparent electrode 16A. In this time, the metal electrodes operate as bus electrodes. This pair of the sustain electrodes is composed of the scan electrode 14 and the sustain electrode 16 depending on a pulse applied thereto. The scan electrode 14 is mainly supplied with a scan pulse for scanning a panel and a sustain pulse for maintaining discharging. The sustain electrode 16 is mainly supplied with the sustain pulse.

The upper dielectric layer 18 and the lower dielectric layer 24 are accumulated with electric charge upon discharging.

The protection film 20 serves to prevent damage of the upper dielectric layer 18 due to sputtering and to increase emission efficiency of secondary electrons. The protection film 20 is typically formed using magnesium oxide (MgO).

The address electrode 22 is formed in a way to intersect the pair of the sustain electrodes 14 and 16. This address electrode 22 is supplied with a data pulse for selecting cells to be displayed.

The barrier ribs 26 are formed parallel to the address electrode 22 and serve to prevent ultraviolet generated by the discharging from leaking toward neighboring cells.

The phosphor layer 28 is coated on the lower dielectric layer 24 and the barrier ribs 26 and emits any one visible ray of red, green and blue lights.

Further, an inert gas for discharging a gas is injected into discharge spaces.

A method of manufacturing the upper substrate of the plasma display panel constructed above will now be described.

FIG. 3 is a view shown to explain a conventional method of manufacturing the upper substrate of the PDP.

A black electrode paste 33 is printed on a transparent electrode 32, i.e., an upper substrate 31 in which an ITO electrode is formed by means of a screen method, and is then dried (FIG. 3*a*).

Thereafter, a first ultraviolet is exposed to the black electrode paste 33 through a first photomask 34 (FIG. 3*b*). It is preferred that the photomask 34 is patterned so that the first ultraviolet is exposed only to the black electrode paste 33 located between discharge cells. Thus, the first ultraviolet is exposed only to the black electrode paste 33 located between the discharge cells, thereby hardening only the exposed portion. A black matrix for precluding light generated from one discharge cell from transmitting to neighboring discharge cells is formed at the exposed portion.

Meanwhile, a silver electrode paste 35 is printed on the exposed black electrode paste 33 by means of a screen-printing method (FIG. 3*c*). A second ultraviolet is exposed to the silver electrode paste 35 through a second photomask 36 (FIG. 3*d*). At this time, it is preferred that the second ultraviolet has a light source having a wavelength that can harden not only the silver electrode paste 35 but also the black electrode paste 33 printed below the silver electrode paste 35, through the second photomask 36. The second photomask 36 is preferably patterned so that the silver electrode paste 35 located over the transparent electrode 32 is hardened.

After the corresponding electrode pastes 33 and 35 are hardened by the second ultraviolet as described above, the upper substrate 31 is developed to form a predetermined bus electrode 37 and a black matrix 38. A dry and sintering process are then performed (FIG. 3*e*). At this time, the bus electrode 37 has a silver electrode 37*b* and a black electrode 37*a*.

Thereafter, a dielectric paste is printed on the upper substrate 31 on which the bus electrode 37 is formed and is then dried, thus forming a predetermined dielectric layer 39. Thereby, the upper substrate of the plasma display panel is completed (FIG. 3*f*).

In the conventional method of manufacturing the upper substrate of the plasma display panel, when the bus electrode is formed, the processes of printing, drying and exposing the black electrode paste and the silver electrode paste are needed twice. Therefore, there is a problem in that the process is very complicated. Further, there is a problem in that additional cost is spent in terms of a manufacturing process.

SUMMARY OF THE INVENTION

Accordingly, an object of the present invention is to solve at least the problems and disadvantages of the background art.

An object of the present invention is to provide a plasma display panel in which a manufacturing process can be simplified and manufacturing cost can be reduced, and method of manufacturing the same.

According to one aspect of the present invention, there is provided a plasma display panel having a front substrate and a rear substrate that are opposite to each other, wherein the plasma display panel includes a pair of transparent electrodes formed on the opposite surface of the front substrate, metal electrodes each formed in the transparent electrodes, a first dielectric layer for covering the transparent electrodes and the metal electrodes, a protection film coated on the first dielectric layer, an address electrode formed on the opposite surface of the rear substrate, a second dielectric layer for covering the address electrode, barrier ribs formed on the second dielectric layer, a discharge cell partitioned by the barrier ribs, and a phosphor layer coated on the inner surface of the discharge cell, wherein the metal electrodes are composed of a green tape having a black electrode formed at the bottom and a silver electrode formed at the top, and are formed by exposing the green tape to ultraviolet rays of different wavelengths consecutively.

According to another aspect of the present invention, there is also provided a method of manufacturing a plasma display panel having a front substrate and a rear substrate that are opposite to each other, wherein the plasma display panel includes a pair of transparent electrodes formed on the opposite surface of the front substrate, metal electrodes each formed in the transparent electrodes, a first dielectric layer for covering the transparent electrodes and the metal electrodes, a protection film coated on the first dielectric layer, an address electrode formed on the opposite surface of the rear substrate, a second dielectric layer for covering the address electrode, barrier ribs formed on the second dielectric layer, a discharge cell partitioned by the barrier ribs, and a phosphor layer coated on the inner surface of the discharge cell, the method including the steps of laminating a green tape that is fabricated in advance on an upper substrate on which the transparent electrodes are formed, consecutively exposing the green tape to ultraviolet rays of different wavelengths, and developing, drying and sintering the exposed green tape to form a metal electrode.

According to the present invention, it is possible to simplify a manufacturing process of a plasma display panel and to reduce manufacturing cost.

BRIEF DESCRIPTION OF THE DRAWINGS

The invention will be described in detail with reference to the following drawings in which like numerals refer to like elements.

DETAILED DESCRIPTION OF PREFERRED EMBODIMENTS

Figure 1:
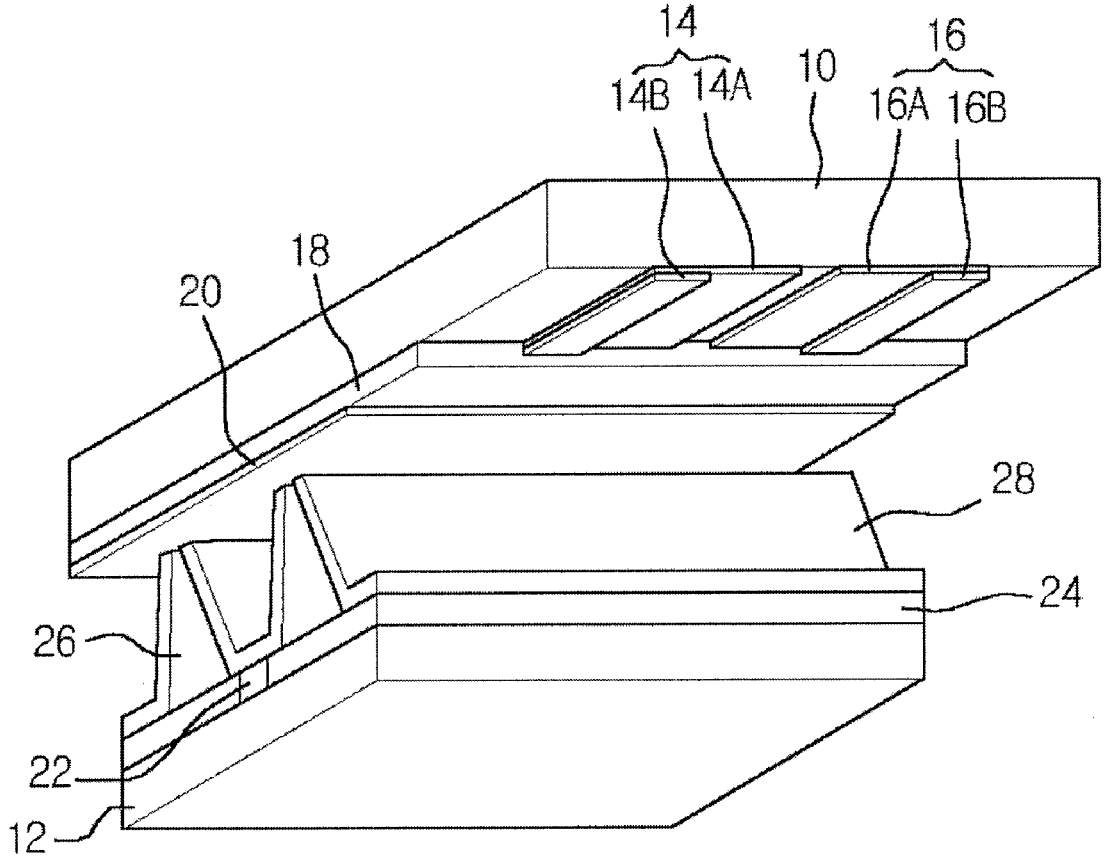
Fig. 1 Prior Art
FIG. 1 is a perspective view showing the configuration of a cell that is arranged on a typical AC type PDP in a matrix shape.
Figure 2:
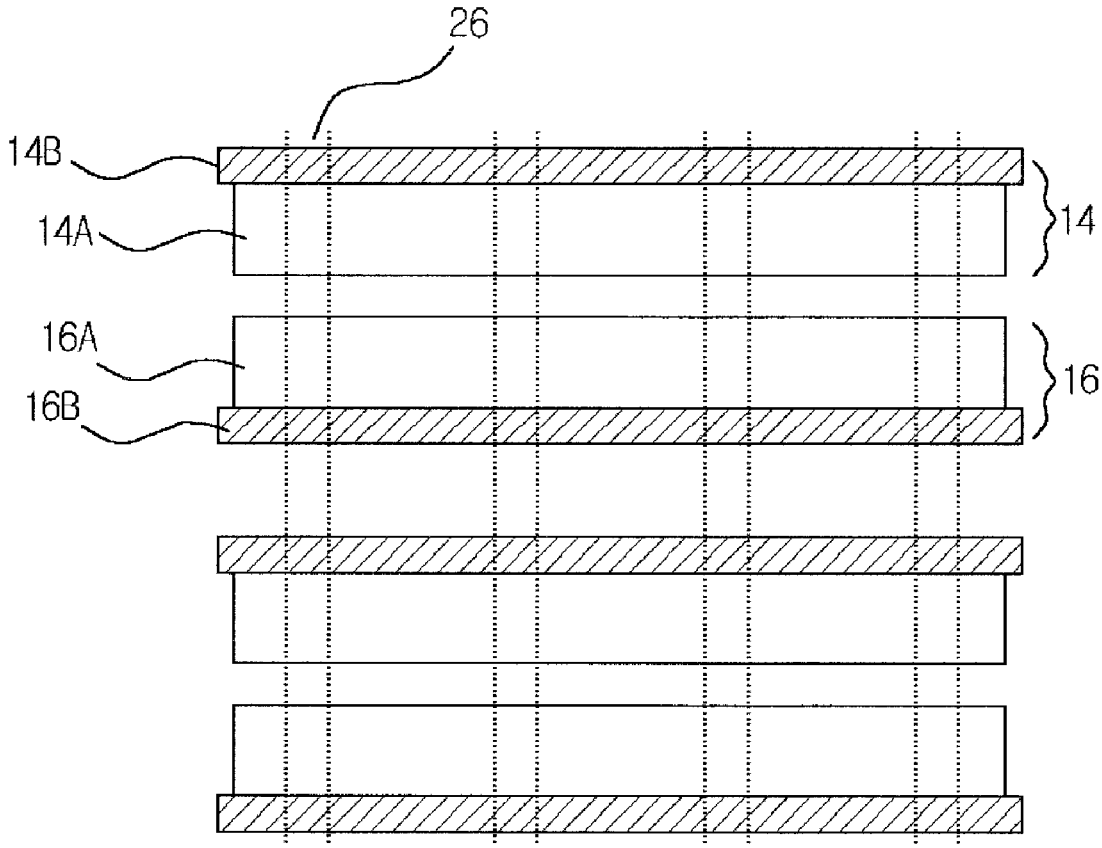
Fig. 2 Prior Art
FIG. 2 schematically shows the structure in which electrodes of an upper substrate of the AC type PDP are arranged.
Figure 3:
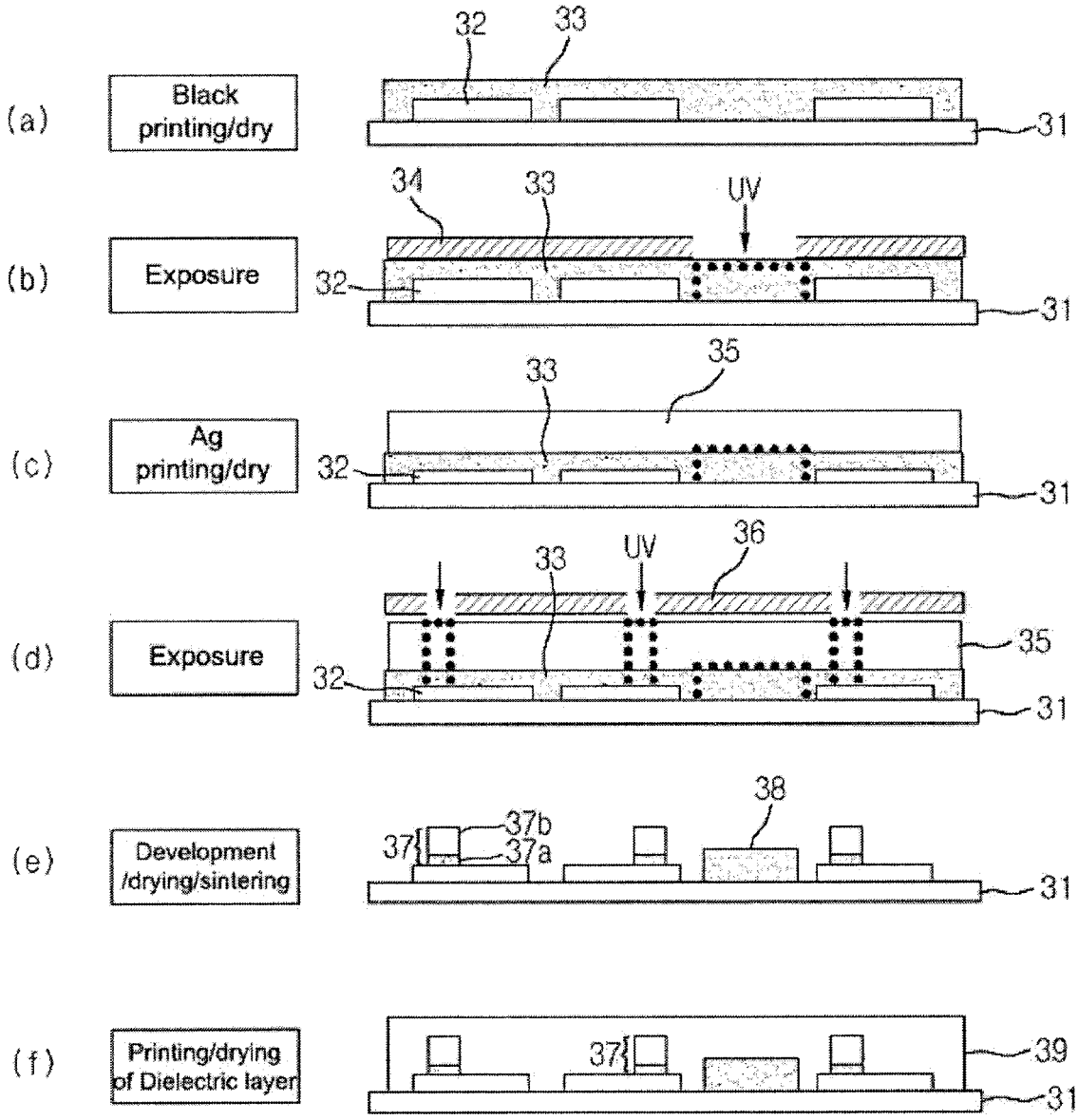
Fig. 3 Prior Art
FIG. 3 is a view shown to explain a conventional method of manufacturing an upper substrate of a plasma display panel.

Preferred embodiments of the present invention will be described in a more detailed manner with reference to the drawings.

According to one aspect of the present invention, there is provided a plasma display panel having a front substrate and a rear substrate that are opposite to each other, wherein the plasma display panel includes a pair of transparent electrodes formed on the opposite surface of the front substrate, metal electrodes each formed in the transparent electrodes, a first dielectric layer for covering the transparent electrodes and the metal electrodes, a protection film coated on the first dielectric layer, an address electrode formed on the opposite surface of the rear substrate, a second dielectric layer for covering the address electrode, barrier ribs formed on the second dielectric layer, a discharge cell partitioned by the barrier ribs, and a phosphor layer coated on the inner surface of the discharge cell, wherein the metal electrodes are composed of a green tape having a black electrode formed at the bottom and a silver electrode formed at the top, and are formed by exposing the green tape to ultraviolet rays of different wavelengths consecutively.

The green tape has a thickness of 10 μm to 100 μm.

The ultraviolet rays of different wavelengths are a first ultraviolet of a short wavelength band and a second ultraviolet of a long wavelength band.

The short wavelength band is a wavelength of below 200 nm and the long wavelength band is a wavelength of 360 nm to 430 nm.

The first ultraviolet of the short wavelength band serves to harden the silver electrode exposed through a first mask.

The second ultraviolet of the long wavelength band serves to harden the black electrode exposed through a second mask.

When the exposed green tape is developed, an non-exposed silver electrode and an non-exposed black electrode are stripped by the different ultraviolet rays.

According to another aspect of the present invention, there is also provided a method of manufacturing a plasma display panel having a front substrate and a rear substrate that are opposite to each other, wherein the plasma display panel includes a pair of transparent electrodes formed on the opposite surface of the front substrate, metal electrodes each formed in the transparent electrodes, a first dielectric layer for covering the transparent electrodes and the metal electrodes, a protection film coated on the first dielectric layer, an address electrode formed on the opposite surface of the rear substrate, a second dielectric layer for covering the address electrode, barrier ribs formed on the second dielectric layer, a discharge cell partitioned by the barrier ribs, and a phosphor layer coated on the inner surface of the discharge cell, the method including the steps of laminating a green tape that is fabricated in advance on an upper substrate on which the transparent electrodes are formed, consecutively exposing the green tape to ultraviolet rays of different wavelengths, and developing, drying and sintering the exposed green tape to form a metal electrode.

The green tape is composed of a green tape having a black electrode formed at the bottom and a silver electrode formed at the top.

The green tape has a thickness of 10 μm to 100 μm.

The ultraviolet rays of different wavelengths are a first ultraviolet of a short wavelength band and a second ultraviolet of a long wavelength band.

The short wavelength band is a wavelength of below 200 nm and the long wavelength band is a wavelength of 360 nm to 430 nm.

The first ultraviolet of the short wavelength band serves to harden the silver electrode exposed through a first mask.

The second ultraviolet of the long wavelength band serves to harden the black electrode exposed through a second mask.

When the exposed green tape is developed, an non-exposed silver electrode and an non-exposed black electrode are stripped by the different ultraviolet rays.

The consecutive exposure step includes hardening the silver electrode of a predetermined region of the green tape and then hardening the black electrode of a predetermined region of the green tape.

The consecutive exposure step includes hardening the black electrode of a predetermined region of the green tape and then hardening the silver electrode of a predetermined region of the green tape.

Hereafter, the embodiments of the present invention will be described in a more detailed manner with reference to the drawings.

A plasma display panel according to an embodiment of the present invention includes a plurality of a pair of first sustain electrodes having a first transparent electrode and a first metal electrode both of which are formed on an upper substrate, a plurality of a pair of second sustain electrodes having a second transparent electrode and a second metal electrode both of which are formed parallel to each other at a given distance from the first sustain electrodes, a plurality of address electrodes formed on a lower substrate in a way to intersect the first and second sustain electrodes vertically, and a plurality of barrier ribs for separating the upper substrate and the lower substrate, wherein the barrier ribs are formed on the lower substrate parallel to the address electrodes.

In the above, the first and second metal electrodes are composed of a green tape having a black electrode formed at the bottom and a silver electrode formed at the top. The first and second metal electrodes are formed by exposing the green tape to ultraviolet rays of different wavelengths consecutively.

It is preferred that the green tape has a thickness of 10 μm to 100 μm. The ultraviolet rays of the different wavelengths may include a first ultraviolet having a wavelength corresponding to a short wavelength band of below 200 nm and a second ultraviolet having a wavelength corresponding to a long wavelength band of 360 nm to 430 nm. It is therefore possible to harden the silver electrode that is exposed to the first ultraviolet having the wavelength of the short wavelength band and the black electrode that is exposed to the second ultraviolet having the wavelength of the long wavelength band. In addition, the remaining regions except for the silver electrode and the black electrode that are hardened as describe above are stripped to form a given bus electrode.

Thereafter, a method of manufacturing a plasma display panel according to an embodiment of the present invention will now be described.

Figure 4:
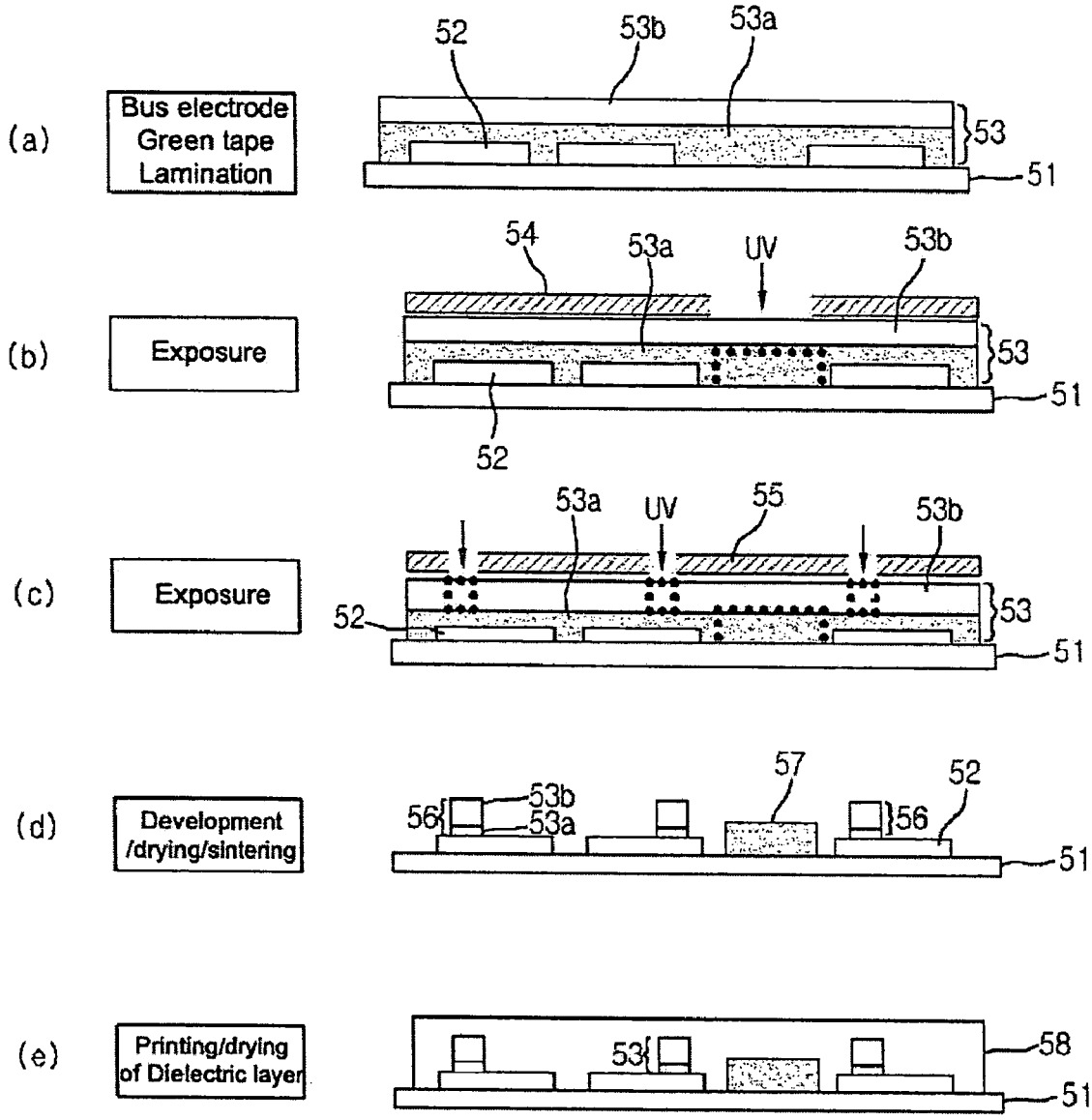
FIG. 4 is a view shown to explain a method of manufacturing an upper substrate of a plasma display panel according to the present invention.

FIG. 4 is a view shown to explain a method of manufacturing an upper substrate of a plasma display panel according to the present invention.

A green tape 53 having a black electrode 53*a* formed at the bottom and a silver electrode 53*b* formed at the top is first prepared. The green tape 53 can be fabricated separately before an upper substrate of the plasma display panel is fabricated. At this time, it is preferred that the green tape 53 is formed in a thickness of 10 μm to 100 μm.

The green tape 53 fabricated thus is laminated on a transparent electrode 52 or an upper substrate 51 in which an ITO electrode is formed. (FIG. 4*a*)

A first photomask 54 is aligned on the laminated upper substrate 51 and the green tape 53 is then firstly exposed to a first ultraviolet (FIG. 4*b*). In more detail, light generated from the first ultraviolet hardens the black electrode 53*a* formed at the lower part of the green tape 53 through a patterned transparent film of the first photomask 54. Therefore, it is preferable that the first photomask 54 is patterned so that the black electrode 53*a* formed on the upper substrate 51 is hardened.

At this time, the first ultraviolet may include a light source of a long wavelength band having a wavelength corresponding to 360 nm to 430 nm. The first ultraviolet of the long wavelength band serves to harden a predetermined region of the black electrode 53*a* formed at the lower part of the green tape 53 through the silver electrode 53*b* at the upper part of the green tape 53. In this time, the predetermined region may be formed in a black matrix for precluding light generated from one discharge cell from transferring to neighboring discharge cells.

Thereafter, a second photomask 55 is aligned on the exposed upper substrate 51. The silver electrode 53*b* formed at the upper part of the green tape 53 is then secondly exposed to a second ultraviolet and is thus hardened (FIG. 4*c*). In this time, the second ultraviolet may include a light source of a short wavelength band having a wavelength corresponding to below 200 nm. The second ultraviolet of the short wavelength band serves to harden a predetermined region of the silver electrode 53*b* formed at the upper part of the green tape 53. At this time, a bus electrode 56 having the black electrode 53*a* and the silver electrode 53*b* is subsequently formed in the predetermined region. It is preferred that the second photomask 55 is patterned so that the silver electrode paste 53*b* formed on the transparent electrode 52 is hardened.

Meanwhile, the consecutive exposure processes can be performed with its order changed. That is, as described above, after the black electrode 53*a* of the predetermined region is hardened using the first ultraviolet, the silver electrode 53*b* of the predetermined region is hardened using the second ultraviolet. It is, however, to be noted that after the silver electrode 53*b* of the predetermined region is hardened using the second ultraviolet, the black electrode 53*a* of the predetermined region can be hardened using the first ultraviolet.

If all the exposure processes are completed, the green tape 53 corresponding to the remaining regions other than the firstly and secondly exposed regions is stripped by developing the upper substrate 51. A dry and sintering process is then performed. Thereby, a given bus electrode 56 and a black matrix 57 are formed (FIG. 4*d*).

Thereafter, a dielectric paste is printed on the upper substrate 51 on which the bus electrode 56 and the black matrix 57 are formed and is then dried, thus forming a predetermined dielectric layer 58. Thereby, the upper substrate of the plasma display panel is completed (FIG. 4*e*).

According to the present invention described above, a green tape having a silver electrode and a black electrode is laminated and a predetermined bus electrode is then formed through a consecutive process. Therefore, the present invention has effects that manufacturing cost as well as the number of a process can be reduced compared to a prior art.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method of manufacturing a plasma display panel having a front substrate and a rear substrate positioned opposite each other, a pair of transparent electrodes provided on a surface of the front substrate facing the rear substrate, a metal electrode provided with each of the transparent electrodes, a first dielectric layer that covers the transparent electrodes and the metal electrodes, a protection film provided on the first dielectric layer, an address electrode provided on a surface of the rear substrate facing the front substrate, a second dielectric layer that covers the address electrode, barrier ribs provided on the second dielectric layer, a discharge cell partitioned by the barrier ribs, and a phosphor layer coated on an inner surface of the discharge cell, the method comprising:

laminating a previously fabricated green tape on a surface of the front substrate on which the transparent electrodes are provided, wherein the green tape includes a black electrode formed at a lower part of the green tape and a silver electrode formed at an upper part of the green tape;

consecutively exposing the green tape to ultraviolet rays of different wavelengths; and developing, drying and sintering the exposed green tape to form a metal electrode.

2. The method as claimed in claim 1, wherein the green tape has a thickness of 10 μm to 100 μm.

3. The method as claimed in claim 1, wherein the ultraviolet rays of different wavelengths include a first ultraviolet ray of a short wavelength band and a second ultraviolet ray of a long wavelength band.

4. The method as claimed in claim 3, wherein the short wavelength band includes wavelengths less than 200 nm and the long wavelength band includes wavelengths between 360 nm and 430 nm.

5. The method as claimed in claim 3, wherein the first ultraviolet ray is directed through a first mask to harden corresponding portions of the silver electrode.

6. The method as claimed in claim 3, wherein the second ultraviolet ray is directed through a second mask to harden corresponding portions of the black electrode.

7. The method as claimed in claim 1, wherein developing the exposed green tape comprises stripping non-exposed portions of the silver electrode and non-exposed portions of the black electrode.

8. The method as claimed in claim 1, wherein consecutively exposing the green tape includes hardening the silver electrode at a predetermined region of the green tape and thereafter hardening the black electrode at a predetermined region of the green tape.

9. The method as claimed in claim 1, wherein consecutively exposing the green tape includes hardening the black electrode at a predetermined region of the green tape and thereafter hardening the silver electrode at a predetermined region of the green tape.

10. A method of manufacturing a plasma display panel, the method comprising:

laminating a previously fabricated green tape on a surface of a front substrate having scan or sustain electrodes formed thereon;

consecutively exposing the green tape to an ultraviolet ray having a short wavelength and an ultraviolet ray having a long wavelength; and developing, drying and sintering the exposed green tape to form a metal electrode.

11. The method of claim 10, wherein the previously fabricated green tape comprises a black electrode provided at a lower portion of the green tape and a silver electrode provided at an upper portion of the green tape.

12. The method of claim 11, wherein exposing the green tape to an ultraviolet ray having a short wavelength comprises directing the ultraviolet ray having a short wavelength through openings in a first mask to harden corresponding portions of the silver electrode, and wherein exposing the green tape to an ultraviolet ray having a long wavelength comprises directing the ultraviolet ray having a long wavelength through openings in a second mask to harden corresponding portions of the black electrode.

13. The method of claim 10, wherein the scan or sustain electrodes include transparent electrodes.

* * * * *